US005318148A

United States Patent [19]

Franco et al.

[11] Patent Number: 5,318,148

[45] Date of Patent: Jun. 7, 1994

[54] ROOF BRACE FOR SUPPORTING A SCAFFOLD PLATFORM

[76] Inventors: Greg Franco, 256 Grove Ave.; Joseph M. Franco, 13242 Horseshoe Rd., both of Oakdale, Calif. 95361

[21] Appl. No.: 61,619

[22] Filed: May 5, 1993

[51] Int. Cl.[5] ..... E04G 5/00

[52] U.S. Cl. ..... 182/45; 248/237

[58] Field of Search ..... 182/45, 120, 121; 248/237

[56] References Cited

U.S. PATENT DOCUMENTS

| | | | |
|---|---|---|---|
| 511,721 | 12/1893 | Burk | 248/237 |
| 909,012 | 1/1909 | McCarty | 248/237 |
| 1,495,868 | 5/1924 | Nielsen | 248/237 |
| 1,864,457 | 6/1932 | Nelson | 248/237 |
| 2,329,415 | 9/1943 | Osborne | 182/45 X |
| 2,729,517 | 1/1956 | Hamilton et al. | 304/20 |
| 3,164,353 | 1/1965 | Rene | 182/45 X |
| 4,607,574 | 8/1986 | Richards | 104/126 |
| 4,856,745 | 8/1989 | Mabie | 248/237 |
| 4,957,185 | 9/1990 | Courchesne et al. | 182/150 |

FOREIGN PATENT DOCUMENTS

| | | | |
|---|---|---|---|
| 919971 | 2/1963 | United Kingdom | 182/45 |

*Primary Examiner*—Alvin C. Chin-Shue

*Attorney, Agent, or Firm*—Robert Samuel Smith

[57] ABSTRACT

A support for a roof scaffold including a triangular frame with one adjustable leg and two other channels each with an end hingably joined to the other channel end and arranged to fold together to form a space where the adjustable leg may be positioned and where accessories may be stored for convenient transport. An outrigger brace having one end attached to the support and another end attachable to the roof remote from the frame provides lateral stability in the direction perpendicular to the channels. The adjustment of leg length and locatin of attachment of one end of the leg to a channel member permits adaptation of the frame to any roof pitch to support a scaffold platform in a horizontal position.

7 Claims, 2 Drawing Sheets

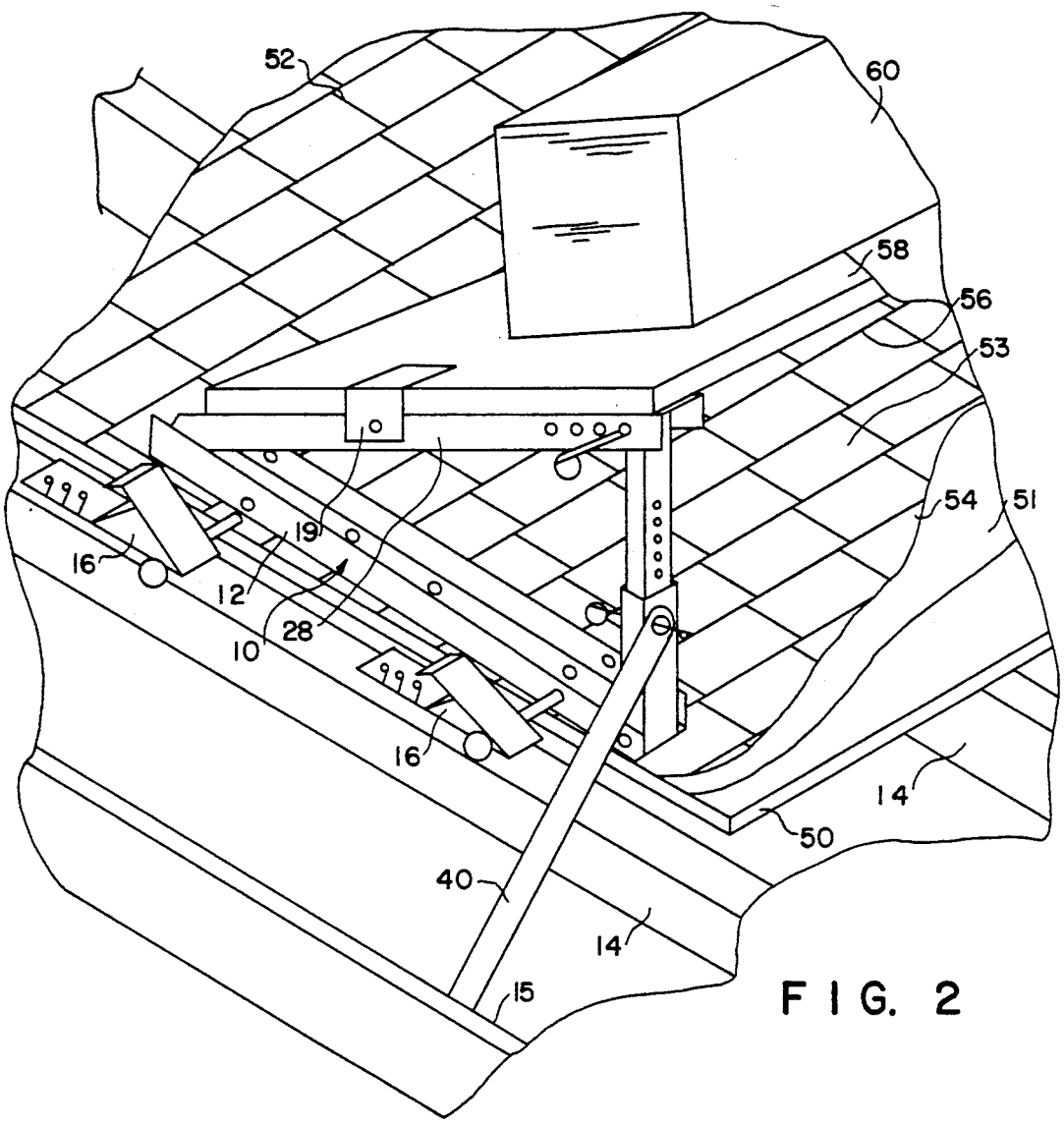
FIG. 2
FIG. 3
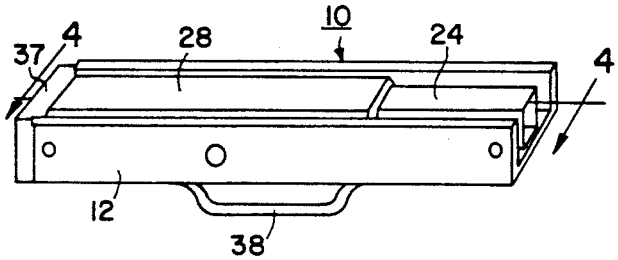
FIG. 4
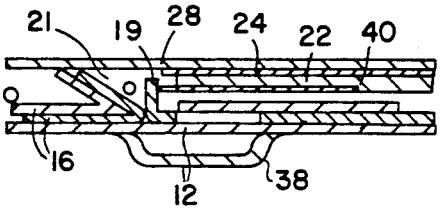

ROOF BRACE FOR SUPPORTING A SCAFFOLD PLATFORM

FIELD OF THE INVENTION

This invention relates to roof scaffolds and in particular to a roof scaffold support that is especially convenient for applying roofing materials and is conveniently transportable.

The program for building the roof of a frame building can be conveniently described as erecting the rafters which are typically sloped at an angle betwen fifteen to forty five degrees, attaching sheets of plywood to the rafters, then laying down roofing material including a first layer of plywood followed by a layer of tar paper then shingles, such as asbestos or otherwise consisting of a resinous composition. Building the roof requires special techniques because of the necessity to carry various tools and materials up to the rooftop worksite and temporally store them there within convenient reach. There is the additional inconvenience and danger to the carpenter because of the necessity for him to move around in order to carry out his job of building the roof so that he may require a temproary walkway for this purpose. In order to ameliorate the job of constructing a roof, a number of braces, scaffolds, etc. have been developed that are intended to satisfy these needs.

U.S. Pat. No. 4,957,185 to Courchesne et al is for a a scaffold bracket for suspending scaffolding from the side of a pitched roof in such a manner as to permit scaffolding up to the edge of the roof without interference from the scaffold since the points of support for the scaffold lie outside the surface of the roof during use. However, this arrangement is useful only when the distance from the lower edge of the roof to the peak of the roof is small.

U.S. Pat. No. 4,607,574 to Richards is for a scaffold supporting a track for conveying "tear off" (old roofing material being replaced) on a cart to the edge of the roof where it is dumped into a waiting truck on the ground. The scaffolding construction is not adaptable to the purpose of laying a roof but is included here to illustrate some of the techniques of the scaffolding art.

U.S. Pat. No. 4,729,517 to Hamilton et al is for a bracket for supporting a plank horizontally on a peaked roof providing a level walking surface.

U.S. Pat. No. 4,856,745 to Mabie is for a triangular plank support brace for a roof having a flat steel bar attachable to the roof such as by nails, an alluminum arm having an adjustable length with one end hingably attached to one end of the steel bar base and a second aluminum arm having one end hingably attached to the other end of the steel bar base and joined at the other end to the other end of the other aluminum leg.

The disclosures of Mabie and Hamilton are characterized by several problems.

Firstly, neither invention is convenient for carrying from job to job or from place to place on the roof top.

Secondly, neither design permits the roofer to apply roofing material under the brace therefore requiring that he must detach and move his brace in order to complete the section of roof on which he is working.

Another disadvantage with the Mabie and Hamilton designs is that these supports are not stable in the lateral direction (which is the end to end direction of the plank).

THE INVENTION

Objects

It is an object of this invention to provide a roof scaffold support for supporting a platform on a roof top.

It is another object that the roof scaffold support be foldable into a compact package for convenvient carrying.

It is another object that the roof scaffold support in the folded condition provide space for storing/transporting accessories.

It is another object that the roof scaffold support be constructed to permit laying roofing material under the scaffold without having to remove the scaffold.

It is another object to provide greater lateral stability than characterizes roof scaffolds of the prior art.

SUMMARY

This invention is directed toward an adjustable triangular frame including a first channel which, in use, is parallel to the rafters, a second channel member hingably secured at one end to an upper end of the first member, and a leg with provisions for an adustable length, substantially vertical and hingably attached at a lower end to the lower end of the first channel member and hingably joined at the upper end to the other end of the horizontal member. The first channel member has horizontal pins through its sides, each pin detachably engaging a cleat secured to a rafter so that the frame is elevated above the roof top sufficiently to allow the workman to slide roofing material between the first channel member and the plywood attached to the rafter. The workman may thereby lay down the roofing shingles over an entire plywood sheet of the roof without having to interrupt his work in order to move the scaffold. He may also detach his support as required by simply withdrawing the pin from each cleat so that he can move the scaffold to another set of cleats at another location. The roof scaffold support is also provided with braces extending laterally and are anchored to neighboring rafters thereby laterally stabilizing the scaffold in the horizontal direction perpendicular to the rafters.

When it is desired to transport or store the scaffold, the adjustable leg is simply folded against the inside of the second channel member and the second channel leg is folded against the inside of the first channel member. A pin through the three legs holds the folded legs together. A handle attached to the first channel member provides a convenient handhold for carrying the folded scaffold like a suitcase. The channel members folded together provides space for receiving the folded adjustable leg but also where accessories such as the cleats and pins may be stored for transportation or storage purposes

DRAWINGS

FIG. 2 shows the roof scaffold support mounted on a peaked roof.

FIG. 3 is a perspective view of the folded roof scaffold support.

FIG. 4 is a sectional view of FIG. 3.

BRIEF DESCRIPTION OF THE BEST MODE

The following descriptions includes several embodiments of the invention including what we presently believe is the best mode for carrying out the invention.

Figure 1:
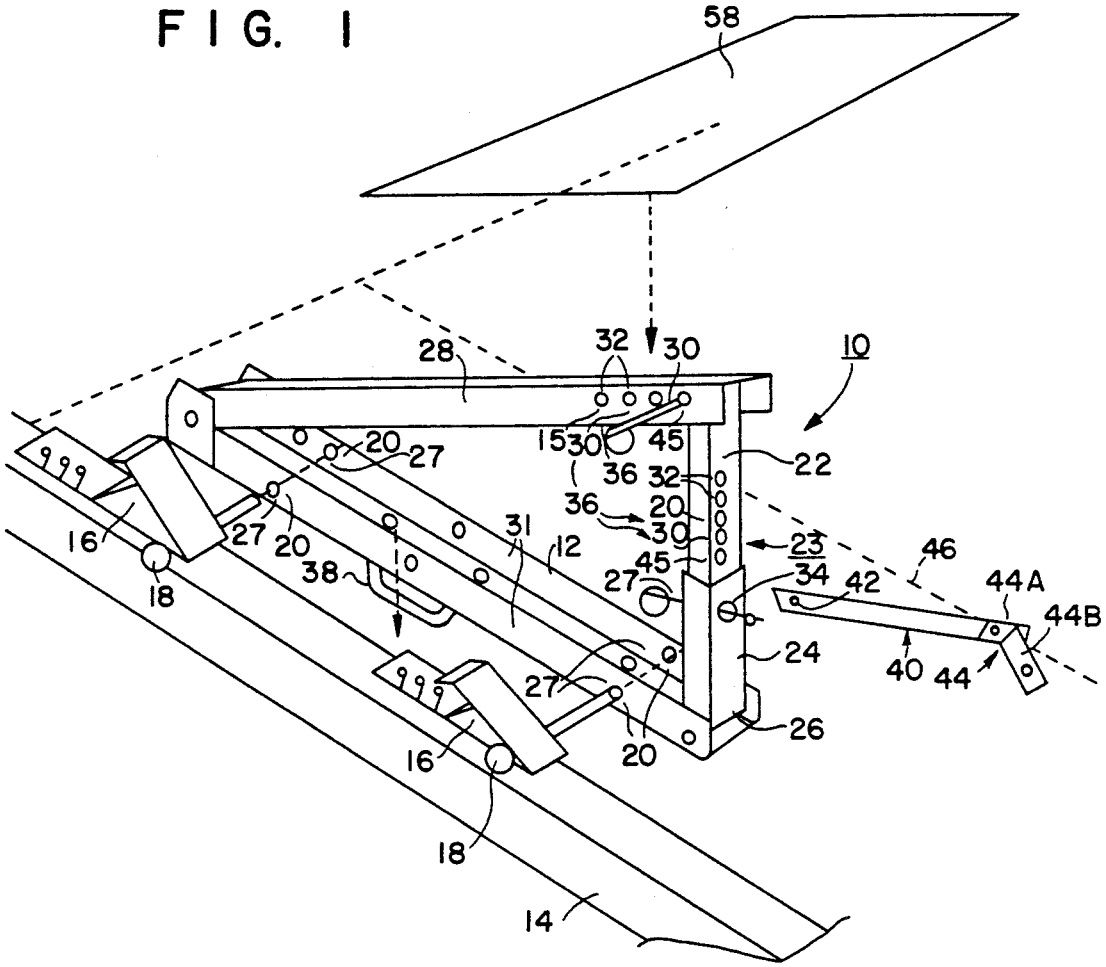
FIG. 1 is a perspective view of the roof scaffold support.

Turning now to a discussion of the drawings, FIG. 1 is a perspective view of the roof scaffold support 10 of this invention. There is shown a first channel 12. In the context of this specification, a channel is understood to mean two elongated parallel side panels each joined along an edge to opposite edges of a joining panel. The outside width of the dhannel is understood to mean the distance between the faces of the side channel facing in opposite directions and the inside width is taken to mean the distance between surfaces of the side panels that are facing one another. When the roof support scaffold is in use on the roof top, the first channel 12 is secured such as to be parallel to the rafters 14. The first channel 12 is detachably mounted on the rafter 14 by two cleats 16 which are nailed to the rafter 14. A pair of pins 18 pass through holes 20 in the sides of the channel 12 and are engaged with the cleats 16.

A telescoping leg 23 includes square tube 22 slidably inserted into an upper open end of square tube 24 whose lower end 26 is hingable attached to an end of first channel 12. The upper end of tube 22 is pinned to a second channel 28 by a pin 30 through a selected one of holes 32 in second channel member 28. The length of leg 23 is determined by a pin 27 through one of holes 32 and hole 34 in the telescoping tubes 22 and 24. The length of the leg is selected according to the pitch of the roof. Indicia 36 stamped on the side of second channel 28 and tube 22 indicate appropriate holes to be pinned depending on the angle of the roof pitch.

In order to provide lateral stability to the scaffold support 10, outrigger brace 40 is provided having one end 42 apertured for attachment to pin 27 through leg 23 and another end provided with an angular bracket 44A pinned to the outrigger brace 40. Another leg 44B of bracket 44 is nailable to a neighboring rafter 46 (shown in phantom).

FIG. 2 is a perspective view of the roof scaffold support 10 mounted on a roof. The roof includes a sheet of plywood 50 (partially cutaway) nailed on rafters 14 covered by tar paper 52 (partially cutaway). Shingles 53 (partially cutaway along line 54 to show the tar paper 52) have been laid on wi area beginning from a lower edge of the roof (not shown) and extending up to line 56 UNDER the plywood platform 58 resting on the roof scaffold support 10. The outrigger brace 40 is shown extending from tube 24 to neighboring rafter 15 thereby providing lateral support to the scaffold. A stack of shingles has been temporarily stored on the scaffold platform 58. The first channel 12 is pinned by pins 18 through holes 27 in side panels 31 of base channel 12 and engaged with cleats 16 so that a space is created between the first channel 12 and the surface of the roof such that the roofing material (shingles) may be laid in this space without interrupting work to move the roof scaffold support 10.

A catch 19 (shown in FIG. 2) is pinned to the side of first channel 12 which secures the scaffold panel 58 to the horizontal support channel 28.

FIG. 3 is a perspective view showing a major feature of the invention which is the ability to fold the roof scaffold support into a neat package such that it can be carried by a handle 38 and create a space bounded by an inside surface of the support channel and an inside surface of the joining panel of the base channel (21 in FIG. 4) where accessories may be conveniently and safely stored. The support is secured in the folded position by a pin 48 through the base and support channel members. As shown in FIG. 3 which is a sectional view of FIG. 2, the outrigger brace 40 is inserted for storage with the adjustble leg into one open end of the folded channels and the cleats 16 are stored in another section of the folded channels. A door 37 in FIG. 3 may be provided on either or both open ends of said folded channels may be provide to secure the stored accessories and brace.

In the foregoing paragraphs a roof scaffold support has been described which meets the objects of the invention. The construction features two channel members and an adjustable length leg which fold into a neat package containing accessories. If the cleats are not used then the storage space may be used to serve purposes such as storing tools, boxes of nails, etc.

Other variations may be contemplated which are within the scope of the invention.

For example, the cleats may be dispensed with and the base channel nailed directly to the roof.

Figure 5:
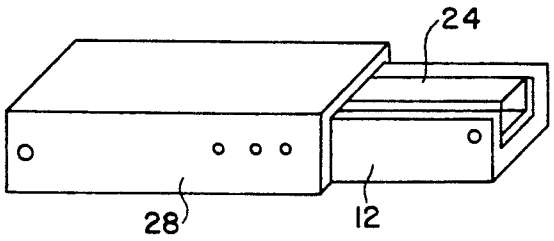
FIG. 5 shows a scaffold support with the base channel nested in the support channel when the device is folded for transport.

As shown in FIG. 5, the base channel may be narrower than the support channel and may be folded into the support channel.

The handle may be attached at a different location than shown in the figs.

We therefore wish to define the scope of our invention by the appended claims and in view of the specification if need be.

We claim:

1. A support for a roof scaffold which comprises:

an elongated first channel having a pair of first side panels joined by a first joining panel;

a second channel having a pair of second side panels joined by a second joining panel;

said second side panels separated by an outside width that is smaller than an inside width between said first side panels;

said second channel having a first end hingably joined to a first end of said first channel by a pin through ends of said first and second side panels such that said second channel is positionable between said first side panels thereby creating a space bounded by an inside surface of said second channel and an inside surface of said first joining panel;

a leg being a first tube having an end telescoped with an end of a second tube and an adjustable length determined by a pin through aligned holes in said first tube and a pair of aligned holes selected from an array of pairs of aligned holes in said second tube;

said first tube having a first end hingably attached to a second end of said first channel with said hingably attached first tube end positioned between said first side panels;

means for detachably engaging another end of said second tube at a selectable location between said second side panels having said second tube with a pair of aligned apertures in sides near an end of said second tube and said pair of apertures alignable with any selected one of a plurality of pairs of aligned apertures in said first side panels arranged in an array extending from a second end of said first side panels such that a pin may be inserted through the aligned apertures thereby securing said support in a rigid triangular configuration in which the angles of the triangular configuration have values depending on the alignment of the apertures and the values of the angles are selected to conform with the angle of the peak of the roof;

means adapted for mounting said first channel on said roof with said leg substantially vertical and said second channel substantially horizontal thereby permitting a platform member to be supported on said second channel and permitting that, when said first channel is detached from said roof, said leg is foldable in said space for convenient transport;

said first side panels having a plurality of pairs of aligned holes;

at least two cleat members, each cleat member adapted to be secured to said roof;

a least two pins, each pin engaging one of said cleats and one of said pairs of aligned holes respectively in said first side panels.

2. A support as in claim 1 which comprises at least one catch means adapted for securing said platform member to said support channel.

3. A support as in claim 1 which comprises:

an outrigger brace having one end hingably attached to said leg and extending in a direction perpendicular to said first and second channels and another end adapted for attachment to said roof thereby stabilizing said scaffold support in a direction perpendicular to said first and second channel members.

4. A roof scaffold support as in claim 1 which includes indicia on said second leg adjacent to each pair of aligned holes of said array and on said side panels adjacent said aligned apertures of said array adapted to aid in selecting pairs of aligned holes and apertures for insertion of said pins corresponding to an angle of pitch of said roof.

5. A support for a roof scaffold which comprises:

an elongated first channel having a pair of first side panels joined by a first joining panel;

a second channel having a pair of second side panels joined by a second joining panel;

said first side panels separated by an outside width that is smaller than an inside width between said second side panels;

said first side panels having a plurality of pairs of aligned holes;

said second channel having a first end hingably joined to a first end of said first channel by a pin through ends of said first and second side panels such that said first channel is positionable between said second side panels thereby creating a space bounded by an inside surface of said first channel and an inside surface of said second joining panel;

a leg being a first tube having an end telescoped with an end of a second tube and an adjustable length determined by a pin through selected aligned holes in said first and second tubes;

said first tube having a first end hingably attached to a second end of said first channel with said hingably attached first tube end positioned between said first side panels;

means for detachably engaging another end of said second tube at a selectable location between said second side panels;

means adapted for mounting said first channel on said roof with said leg substantially vertical and said second channel substantially horizontal thereby permitting a platform member to be supported on said second channel and permitting that, when said first channel is detached from said roof, said leg is foldable in said space for convenient transport;

at least two cleat members, each cleat member adapted to be secured to said roof;

a least two pins, one pin engaging one of said cleats and one of said pairs of aligned holes respectively in said first side panels.

6. A support as in claim 5 wherein said detachably engaging means comprises:

said second tube having a pair of aligned apertures in sides near an end of said second tube said pair of apertures alignable with any selected one of a plurality of pairs of aligned apertures in said first side panels arranged in an array extending from a second end of said first side panels.

7. A support for a roof scaffold which comprises:

an elongated first channel having a pair of first side panels joined by a first joining panel;

a second channel having a pair of second side panels joined by a second joining panel;

said second side panels separated by an outside width that is smaller than an inside width between said first side panels;

said second channel having a first end hingably joined to a first end of said first channel by a pin through ends of said first and second side panels such that said second channel is positionable between said first side panels thereby creating a space bounded by an inside surface of said second channel and an inside surface of said first joining panel;

a leg being a first tube having an end telescoped with an end of a second tube and an adjustable length determined by a pin through aligned holes in said first tube and a pair of aligned holes selected from an array of pairs of aligned holes in said second tube;

said first tube having a first end hingably attached to a second end of said first channel with said hingably attached first tube end positioned between said first side panels;

means for detachably engaging another end of said second tube at a selectable location between said second side panels;

means adapted for mounting said first channel on said roof with said leg substantially vertical and said second channel substantially horizontal thereby permitting a platform member to be supported on said second channel and permitting that, when said first channel is detached from said roof, said leg is foldable in said space for convenient transport;

at least one door, each of said at least one door hingably attached to an end of said first channel such that when said door is closed, said space is bounded by said door thereby adapting said support for preventing accessories stored in said space from sliding out of said space during transport of said support.

* * * * *